United States Patent [19]

Stacy et al.

[11] 4,006,708

[45] Feb. 8, 1977

[54] ELECTROGRAPHIC DEVELOPMENT APPARATUS

[75] Inventors: Peter M. Stacy, Webster; Richard A. Weitzel, Hilton, both of N.Y.

[73] Assignee: Eastman Kodak Company, Rochester, N.Y.

[22] Filed: May 1, 1975

[21] Appl. No.: 573,658

[52] U.S. Cl. ..... 118/650; 118/419; 427/14

[51] Int. Cl.[2] ..... G03G 13/08

[58] Field of Search ..... 118/637, 419, 429; 427/14

[56] References Cited

UNITED STATES PATENTS

| | | | |
|---|---|---|---|
| 2,761,416 | 9/1956 | Carlson | 118/637 |
| 2,972,332 | 2/1961 | Limberger | 118/637 |
| 3,117,030 | 1/1964 | Jons et al. | 118/637 |
| 3,605,693 | 9/1971 | Zweig | 118/637 |
| 3,870,017 | 3/1975 | Kratcoski et al. | 118/637 |
| 3,871,329 | 3/1975 | Anemaet | 118/637 |

*Primary Examiner*—Mervin Stein
*Attorney, Agent, or Firm*—J. D. Husser

[57] ABSTRACT

A flexible latent image-bearing photoconductive element is driven through a U-shaped path to form a self-contained electrographic developer reservoir to which electrically conductive toner particles are supplied. A grounded, electrically conductive, apertured member positioned in the toner reservoir in close proximity to the image-bearing surface of the photoconductor imparts continuous motion to the toner particles as the image-bearing element moves therepast. The motion creates a sweeping action which reduces the amount of toner background present in a finished print.

6 Claims, 1 Drawing Figure

ELECTROGRAPHIC DEVELOPMENT APPARATUS

BACKGROUND OF THE INVENTION

1. Field of the Invention

The present invention relates to electrographic development apparatus and, more particularly, to development apparatus for presenting an electrically conducting developing material to a surface bearing a latent electrostatic image.

2. Description of the Prior Art

A number of techniques are known in the art for developing latent electrostatic charge patterns carried on an image-bearing support surface. In one widely used technique, a developer mixture is formed by mixing finely divided, pigmented, insulating toner particles with relatively larger carrier particles. The surface characteristics of these materials are selected to be different so that surface electrical charges of mutually opposite polarity are produced on the toner particles and carrier particles creating a physically attractive force between them. To produce a visible image, the developer mixture is presented to a latent electrostatic charge pattern on an image-bearing support surface. In the charged areas, the toner particles are separated from the triboelectrically attracted carrier particles by the stronger forces associated with the electrostatic image. However, in the uncharged areas, no toner particles are deposited because the toner particles remain physically attracted to the carrier particles. Developing systems using two component developer mixtures have a number of detractive aspects including a high cost of manufacture, the need to maintain the ratio of the developer mixture within narrow limits, a tendency for the mixture to agglomerate and a limitation as to the form of image produced, i.e., negative or positive.

Another known developing technique contacts the latent electrostatic charge pattern with single component, electrically conductive developer particles. When a charged area is so contacted, an opposite polarity charge is induced to the developer particles, in an amount which is directly proportional to field strength, creating an electrically attractive force sufficient to hold one or more particles to the charge-bearing surface. In the uncharged areas no charges are induced and therefore no toner particles are attracted. However, due to Van der Waal's and other forces, a large number of toner particles contacting the background areas of the image remain adhering creating an undesirable background haze in the copies produced. When the electrostatic charge pattern is created by uniformly charging a photoconductor in darkness and then exposing the photoconductor to an imagewise light pattern, the attractive forces exerted by the residual voltages present in the light exposed, background areas increase the density of toner background deposition. Another disadvantage of conductive developing systems is their tendency to create an airborne toner cloud which contaminates the machine components thereby necessitating frequent cleaning. The latter problem is known in the art as "toner dusting."

Background toner depositation can be controlled by the use of a free-flowing, magnetically responsive, electrically conductive developer powder in combination with a magnetic applicator. By properly adjusting the magnetic field strength, the magnetic force of attraction between the developer particles and the applicator is greater than the forces of attraction which may exist between the developer particles and the background areas of the image pattern bearing surface. As a result, the developer particles remain adhered to the surface of the applicator when the applicator is removed from the background areas. In the charged image areas, however, the magnetic force of attraction between the developer particles and the applicator is less than the electrical force of attraction between the particles and the charge-bearing surface. The particles are, therefore, separated from the magnetic applicator and transferred to the charge-bearing surface. While effective in reducing toner background deposits, a magnetic development system has the obvious disadvantage of increased complexity and cost.

SUMMARY OF THE INVENTION

It is, therefore, an object of the invention to provide development apparatus for use with single component electrically conductive developer material which is of simple construction and yet highly effective in reducing toner deposition in the background areas of the prints produced.

Another object of the invention is to provide a development apparatus with reduced toner dusting.

These and other objects are accomplished in accordance with the present invention by positioning an apertured member, such as a wire screen, in a developer reservoir containing a conductive developer material having a conductivity as herein defined of $10^{12}$ ohm-cm to $10^{3}$ ohm-cm. Movement of the image-bearing surface past the apertured member during the development process creates a turbulent motion in the conductive developer particles which sweeps away developer particles loosely held to the uncharged areas of the image-bearing surface. This sweeping action considerably reduces the amount of toner background present in the finished print. The apertured member also helps to contain the developer particles thereby reducing the problem of toner dusting common to this type of development. Advantageously, the apertured member is electrically grounded providing an electrically conductive path for rapidly dissipating any electrical charges generated on the developer material. Since the path to ground afforded by the apertured member is better than that provided by particle to particle contact, higher resistance developer materials, i.e., in the range of $10^{8}$ ohm-cm to $10^{12}$ ohm-cm, are useful in the practice of the invention.

In a preferred embodiment, the developer apparatus utilizes an elongated, flexible, charge patterned element driven along a U-shaped development path so that the element forms a self-contained developer reservoir. The self-contained developer reservoir allows "face-up" development thus avoiding contamination by the developer material in or on the rear surface of the charge patterned element without requiring the use of special electrical or chemical barrier layers.

The invention, its objects and advantages will become more apparent to those skilled in the art by referring to the accompanying drawing and to the ensuing detailed description of the preferred embodiment which follows.

BRIEF DESCRIPTION OF THE DRAWING

The drawing is a schematic illustration of an electrographic development apparatus constructed in accordance with a preferred embodiment of the invention.

DETAILED DESCRIPTION OF THE PREFERRED EMBODIMENT

Figure 1:
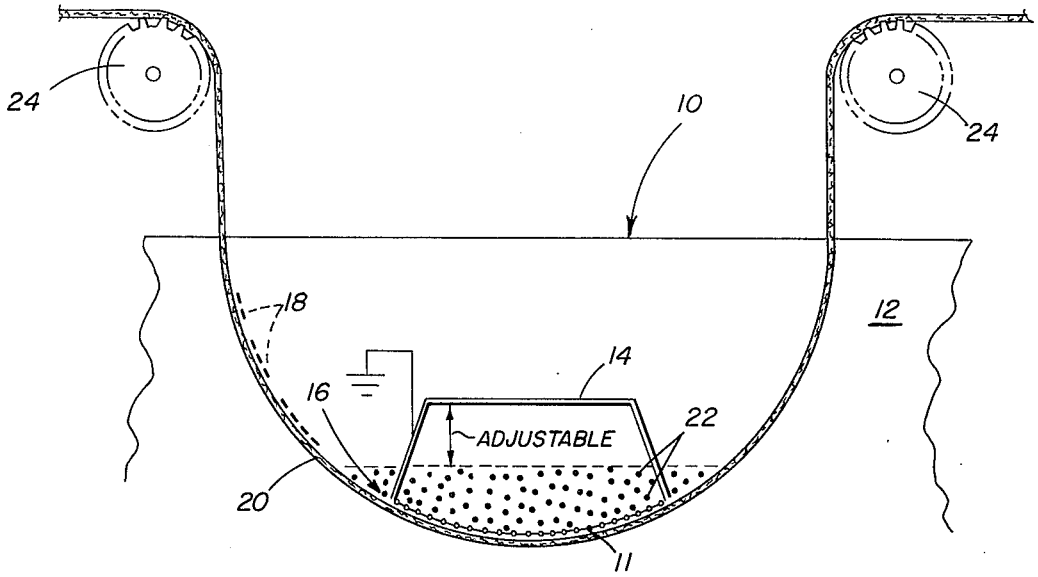

Referring now to the drawing there is shown an illustrative electrographic development apparatus utilizing the invention of the present application. The development apparatus, designated generally by the reference numeral 10, is formed by driving a flexible, latent image-bearing support element 20 around sprocket rollers 24 in a manner which forms the element 20 in a U-shaped loop so that the charge-bearing surface 18 of the element 20 lies on the concave side of the loop (i.e., faces upwardly in the drawing). The loop-shaped portion of the element 20 in cooperation with two opposed side walls 12 (only one of which is shown in the drawing) forms a self-contained, open-topped reservoir 16. Use of the element 20 as a self-contained development reservoir advantageously allows simple immersion development without requiring the use of special backing layers on the element 20 to prevent adherence of developer particles to the rear surface of the element.

The reservoir 16 is supplied with a single component, finely divided, colored electrically conductive developer material 22 by a distribution device (not shown) positioned over the looped portion of the element 20 so that the developer material falls onto the charge-bearing surface 18 and forms a pile. To be useful in the practice of the invention, the electrically conductive developer material 22 has a resistivity of $10^{12}$ ohm-cm to $10^{3}$ ohm-cm when measured in the following manner. The developer material is placed between two concentric, gold plated brass cylinders having an effective length of 3.5 cm. The diameter of the inner cylinder is 0.52 cm and the diameter of the outer cylinder is 0.95 cm. A center section of the outer cylinder, 2.54 cm in length, is electrically isolated from the ends of the cylinder by 0.02 cm Teflon washers (Teflon is a trademark of E. I. du Pont de Nemours and Co. used to designate a plastic consisting of a tetrafluoroethylene polymer). A voltage source is connected to the inner cylinder and a current measuring device is connected to the center section of the outer cylinder. The entire assembly is enclosed in a metal case and grounded by connection to the ends of the outer cylinder.

To measure resistivity, a potential of 25 volts is applied to the inner cylinder and the current through the developer material measured. The resistivity; $\rho$, in ohm-cm, is calculated as $$\rho = 26.6\ V/I,$$

where $V$ is the applied voltage in volts and $V$ is the measured current in amps.

Positioned in the developer reservoir 16 in close proximity to the charge-bearing surface 18 of the element 20 is a multi-apertured member 11 rigidly mounted to an electrically grounded conductive metal frame 14. In the illustrative embodiment shown in the drawing, the multi-apertured member comprises a number 12 gauge brass wire screen. Other electrically conductive, multi-apertured devices are useful including, for example, an array of parallel metal rods and a metal rod formed in the shape of a helix. The frame 14 is mounted to supporting structure of the electrographic copying machine in which the development apparatus 10 is used, by means (not shown) which allows the position of the apertured member 11 to be selectively varied relative to the charge image pattern bearing surface 18 (shown for the purposes of illustration as negative charges) of an element 20 moving through the reservoir 16. For each particular electrically conductive developer material 22 used in the apparatus 10, the position of the apertured member 11 is adjusted to provide an appropriate amount of tumbling action to such developer material and an electrically conductive path which rapidly dissipates any electrical charges generated on the developer material by the tumbling action. The tumbling and charge dissipation features of the apertured member 11 are discussed in detail in the succeeding paragraphs.

As the element 20 moves through the developer filled reservoir 16, the apertured member 11 functions to tumble the developer particles 22 across the charged image pattern bearing surface 18. This tumbling action sweeps away developer particles loosely attracted to the uncharged areas of the surface 18 by gravitational, electrical and/or Van der Waals forces. The result of the tumbling action is a finished print with considerably reduced toner deposition in the background area.

The apertured member 11 also functions as a cover for the developer material 22 reducing the amount of developer throw-off (i.e., toner dusting) which contaminates the machine components.

When the development apparatus 10 is used at high development speeds (i.e., speeds greater than 20 inches/sec.) or when development materials having resistivity of more than $10^{7}$ ohm-cm are used, the developer materials have a propensity to become triboelectrically charged resulting in reduced solid area development characteristics and/or reversal development.

To increase the range of developer materials useful as a conductive toner and/or to increase the development speed of the apparatus 10, the apertured member 11 is electrically grounded through frame 14 providing an electrically conductive path which rapidly dissipates any electrical charges generated on the developer material 22. By grounding the apertured member 11, good development results can be achieved with developer materials having resistivities ranging from $10^{3}$ – $10^{12}$ ohm-cm at development speeds up to 40 inches/sec. Use of developer materials at the lower end of the conductivity scale advantageously provides the possibility of utilizing a more conventional electrostatic transfer technique, if transfer of the developed image to a final receiver material is desired.

The operation of the invention is illustrated by the following example. An elongated, aggregate photoconductive element formulated in accordance with the teachings of U.S. Pat. No. 3,615,414 issued Oct. 26, 1971 in the name of Light, was positioned about the sprocket rollers 24 so that a portion of the element 20 was formed into a U-shaped loop providing a self-contained development reservoir 16. The reservoir 16 was filled with a single component, electrically conductive developer material 22 comprising Emery Industries' 1538 Polyamide Beads which had been reformed into spherical particles having a diameter of from 35 – 45 microns. The spherical particles were ball milled with carbon XC-72 manufactured by Cabot Corporation until the particles contained 3% by weight of carbon. The particles were then washed and dried three times with 2% Alconox (a trademark of Alconox Incorporated for a detergent) to remove unimbedded carbon material. The resistivity of the developer material, when measured by the above-described procedure, was found to be $10^8$ ohm-cm. The photoconductive element was uniformly charged to a negative potential of 400 volts and then light exposed to a pattern of information. With the apparatus 10 electrically grounded and the apertured member 11 positioned approximately ⅛ inch from the charge bearing surface 18, the photoconductive element was advanced about the rollers 24 at a linear rate of approximately 20 inches per second. Sharp images of good density and low background were obtained.

From the foregoing, the beneficial effects of the invention are readily apparent. Novel development apparatus for use with conductive developers has been disclosed which produces high density images with low background with extremely simple, economical and compact components.

The invention has been described with reference to a preferred embodiment thereof but it will be understood that variations and modifications can be effected within the spirit and scope of the invention. For example, the shape of the developer reservoir 16 can vary as well as the manner in which it is formed. If desired, provision for prevention of developer leakage can be made by suitable gasket designs.

We claim:

1. In an electrographic development apparatus of the type in which a support having thereon an electrostatic charge pattern defining image areas and non-image areas moves through a container filled with single component, dry, electrically conductive toner particles, the improvement comprising a grounded electrode means positioned in such toner container in close proximity to the charge patern bearing surface, said electrode means being constructed to provide an electrical path for dissipating electrical charges generated on the toner particles and to impart a tumbling movement to the toner particles.

2. The apparatus according to claim 1 wherein said electrode means comprises an apertured member formed of an electrically conductive material.

3. The apparatus according to claim 2 wherein said electrode means comprises a wire screen.

4. Electrographic apparatus for applying a single component, dry, electrically conductive developer material to an elongated recording element bearing a latent electrostatic image pattern on one surface thereof, said apparatus comprising:

means defining a recording element feed path, at least a portion of said path being of U-shape;

a transport mechanism for advancing the recording element along said feed path with the image-bearing surface of the recording element facing upwardly so that the recording element forms a self-contained, open-topped, developer reservoir for the developer material; and an electrically conductive, grounded, apertured member positioned in the developer reservoir in close proximity to the image-bearing surface of the recording element so as to provide a tumbling action to the developer material and an electrically conductive path which rapidly dissipates any electrical charges generated on the developer material.

5. The apparatus according to claim 4 wherein said apertured member is stationarily positioned in the developer reservoir and said apparatus further includes means for adjusting the position of said apertured member relative to said feed path.

6. The apparatus according to claim 1 wherein said electrode means is stationarily positioned in the developer reservoir.

* * * * *